United States Patent [19]

Butts

[11] Patent Number: 4,825,022

[45] Date of Patent: Apr. 25, 1989

[54] MAIL SORTING COMPUTER KEYBOARD

[75] Inventor: Gary C. Butts, Orange County, Calif.

[73] Assignee: Labworks Inc., Huntington Beach, Calif.

[21] Appl. No.: 923,187

[22] Filed: Oct. 27, 1986

[51] Int. Cl.[4] ..... H01H 3/20

[52] U.S. Cl. ..... 200/343; 200/332; 200/5 R; 200/335; 200/159 R; 200/340; 400/496

[58] Field of Search ..... 200/5 R, 5 A, 153 H, 200/153 T, 330, 332, 335, 329, 339, 340, 159 R; 84/236; 340/365 R; 400/472, 488, 496

[56] References Cited

U.S. PATENT DOCUMENTS

| | | | |
|---|---|---|---|
| 1,988,913 | 1/1935 | Modigliani | 400/496 X |
| 2,060,719 | 11/1936 | Bates | 400/496 X |
| 3,292,761 | 12/1966 | Erpel | 400/496 |
| 3,938,642 | 2/1976 | Van Rumpt et al. | 400/496 X |
| 3,981,385 | 9/1976 | Mueller et al. | 400/496 X |
| 4,063,056 | 12/1977 | Baker | 200/332 |
| 4,434,340 | 2/1984 | Kondo | 200/332 |

FOREIGN PATENT DOCUMENTS

| | | | |
|---|---|---|---|
| 191000 | 7/1957 | Austria | 200/153 H |

*Primary Examiner*—Henry J. Recla
*Assistant Examiner*—Ernest G. Cusick

[57] ABSTRACT

An improved mail sorting computer keyboard, having a plurality of keys arranged in first and second groups for rotational movement, is provided. A first rod is disposed through apertures of each key of the first group of keys while a second rod is disposed through apertures of each key the second group of keys. A third rod extending transversely across the keyboard and under a front portion of the first group of keys and a fourth rod extending above the first group of keys define the rotational arch for the first group of keys. A fifth rod transversely disposed under a front portion of the second group of keys and a sixth rod transversely disposed under the rearward portion of the second group of keys defines the rotational arch for the second group of keys. Each key of the keyboard actuates a corresponding electrical switch for sending impulses to a mail sorting computer. The mail sorting computer keyboard also includes a circuit for translating coordinates denoting a particular key into the corresponding coordinates of a key of any other computer with which it may be desired to interface the mail sorting computer keyboard.

2 Claims, 5 Drawing Sheets

MAIL SORTING COMPUTER KEYBOARD

BACKGROUND OF THE INVENTION

1. Field of the Invention

The present invention relates to keyboards and more particularly, to keyboards having keys for use with digital computer systems such as, for example, mail sorting computer keyboards.

2. Art Background

Prior art keyboards used in conjunction with mail sorting equipment typically have various adjustment mechanisms for determining the maximum downward and upward movement of the keys. After extended use of the keyboard, such adjustment mechanisms frequently go out of alignment, such that the keyboard does not function in its intended manner, thereby requiring readjustment of the adjustment mechanisms. The afore-stated problem of prior art keyboards is particularly critical in mail sorting keyboards which are used by the United States Postal Service in conjunction with mail sorting machines.

In FIG. 2 there is shown a perspective interior view of a lower portion of a typical prior art mail sorting keyboard generally denoted by reference numeral 9. The prior art mail sorting keyboard 9 has two lateral portions 9A and 9B which are disposed at each longitudinal end of the keyboard 9, and which are separated by a gap 53. Keyboard portion 9B mirrors, but is otherwise identical to keyboard portion 9A, and, therefore, a description of keyboard portion 9A will fully convey to the reader an appreciation of the problems and drawbacks associated with such prior art keyboards.

Keyboard portion 9A of FIG. 2 is comprised of a plurality of keys 7 which are longitudinally aligned with one another, each key of the plurality of keys 7 is comprised of a plastic portion 7A which is disposed over and attached to a pair of supporting arms 7B. The supporting arms 7B each join a transverse portion 7C which is disposed across arms 7B at the region thereof underlying plastic portions 7A, as shown in FIG. 2. Each pair of supporting arms 7B has disposed at the ends thereof opposite the plastic portion 7A of the keys 7 recesses 51 and 52 through which is disposed an elongate rod 6 which has a circular cross section uniformly along its length such that together, recesses 51 and 52 and elongate rod 6 provide a pivot means for each of the keys 7. Disposed generally underneath each pair of supporting arms 7B is an electrical switch 8 which is interfaced with a mail sorting keyboard system (not shown). Disposed above each electrical switch 8 is an alignment means 11 which is comprised of a transverse plate portion 11A, a threaded collar portion 11B and a threaded bolt 11C which has a flanged bottom portion 11D. The transverse plate portion 11A is coupled to each upper edge of supporting arms 7B, as shown in FIG. 2, and is unitary therewith. Disposed generally in the center of transverse plate portion 11A is the threaded collar portion 11B. Threaded through threaded collar portion 11B is the threaded bolt 11C which has the bottom flanged portion 11D. Disposed underneath the flanged portion 11D of the threaded bolt 11C there is disposed a pressure actuated switch portion (not shown) which comprises a part of each electrical switch 8. When a key is depressed, the flanged portion 11D of the bolt 11C comes into contact with and depresses the pressure actuated switch portion of a corresponding switch 8 thereby closing electrical switch 8 and initiating a predetermined pulse to the mail sorting keyboard system.

Threaded bolt portion 11C has a central opening into which may be inserted an allenhead wrench for threading the bolt through threaded collar portion 11B in an upwards or downwards direction. It will be appreciated that after constant use, each threaded bolt 11C will thread upwards or downwards thereby increasing or decreasing the distance between the flanged portion 11D and the pressure actuated switch portion of the switch 8. As such, the pressure actuated switch portion of each switch 8 will then be improperly actuated. At such time, each threaded bolt 11C must be adjusted such that the distance between the flanged portion 11D is properly set so that the pressure actuated switch portion of switch 8 is properly actuated when a corresponding key is depressed.

Also disposed transversely across and above the plurality of keys 7 is a second alignment means 13 which is similar to alignment means 11, and which comprises a transverse channel 13A disposed transversely across the keyboard 9 adjacent to the end of plastic portions 7A. As shown in FIG. 2, disposed along the transverse channel 13A is a plurality of threaded collar portions 13B, each of which is disposed above each key of the plurality of keys 7. Disposed within each threaded collar portion of alignment means 13 is a plurality of threaded bolts 13C each having a bottom flanged portion (not shown), which are also disposed above each transverse portion 7C of each key of the plurality of keys 7. Each bolt 13C is threadedly engaged with a corresponding threaded collar portion 13B. Disposed under each key of the keys 7 is a spring (not shown) which upwardly biases each key. As such, each flanged portion of each bolt, when a key is not depressed by a user, abuts against a felt member portion 13E thereby determing the extent of upward movement of each key of the plurality of keys 20. It will be appreciated that over periods of constant use, the bolt 13C may turn upwards or downwards within threaded collar 13D, thereby increasing or decreasing the extent of upward or downward movement of the corresponding key of the plurality of keys 7 thereby also causing the key to go out of alignment, and necessitating realignment by turning the bolt 13B in the same manner as previously discussed with respect to bolt 11C of alignment means 11.

It will be further appreciated that since each key of keyboard portion 9A has two alignment means, 11 and 13, each of which comprises five separate portions, the plurality of keys 7 have, collectively, ten separate alignment mechanisms each of which must be periodically adjusted over the course of the operation of the keyboard portion 9A. Taking into account keyboard portion 9B, it will be appreciated that keyboard 9 periodically requires twenty individual adjustments in order to keep the keys properly aligned. Such periodic and multiple adjustments result in downtime of the keyboard 9 thereby incurring great cost. Moreover, in situations wherein the adjustment means 11 and 13 are out of alignment and the keyboard 9 is operated, the pressure actuated switch portions of switches 8 are often not actuated when a corresponding key is depressed such that, electronic pulses are not properly conveyed to the mail sorting keyboard system thereby causing inputting errors, and resulting in an improper classification of the mail being sorted. Additionally, since the prior art mail sorting keyboard 9 is comprised of many intricate parts, manufacture and assembly of the same is costly and a complicated procedure.

SUMMARY OF THE INVENTION

It is an object of the present invention to provide an improved mail sorting computer keyboard which has fewer parts than prior art mail sorting keyboards and yet accomplishes superior results.

It is a further object of the present invention to provide an improved mail sorting computer keyboard which may be easily and quickly manufactured at a minimum cost.

It is a further object of the present invention to provide an improved mail sorting computer keyboard in which the keys are correctly and substantially permanently aligned such that errors in mail sorting are substantially reduced.

Still a further object of the present invention is to provide an improved mail sorting computer keyboard which does not require periodic adjustment and where downtime, over the course of operation of the keyboard, is greatly reduced.

The objects and drawbacks contained in the prior art are overcome in a keyboard comprising a plurality of keys. Each key of the plurality of keys having an aperture extending transversely therethrough. The plurality of keys are divided into first and second groups. The keyboard further includes a first and second rods disposed, respectively, through each aperture of the first and second group of keys and such that the first and second rods the apertures collectively provide first and second pivots for each key of the plurality of keys. The invented keyboard also includes a spring for biasing each key and third and fourth, fifth and sixth rods fixedly disposed adjacent respectively the first and second group of keys to limit the extent of upward and downward movement of the plurality of keys substantially permanently aligning said plurality of keys.

DESCRIPTION OF THE PREFERRED EMBODIMENT

Figure 1:
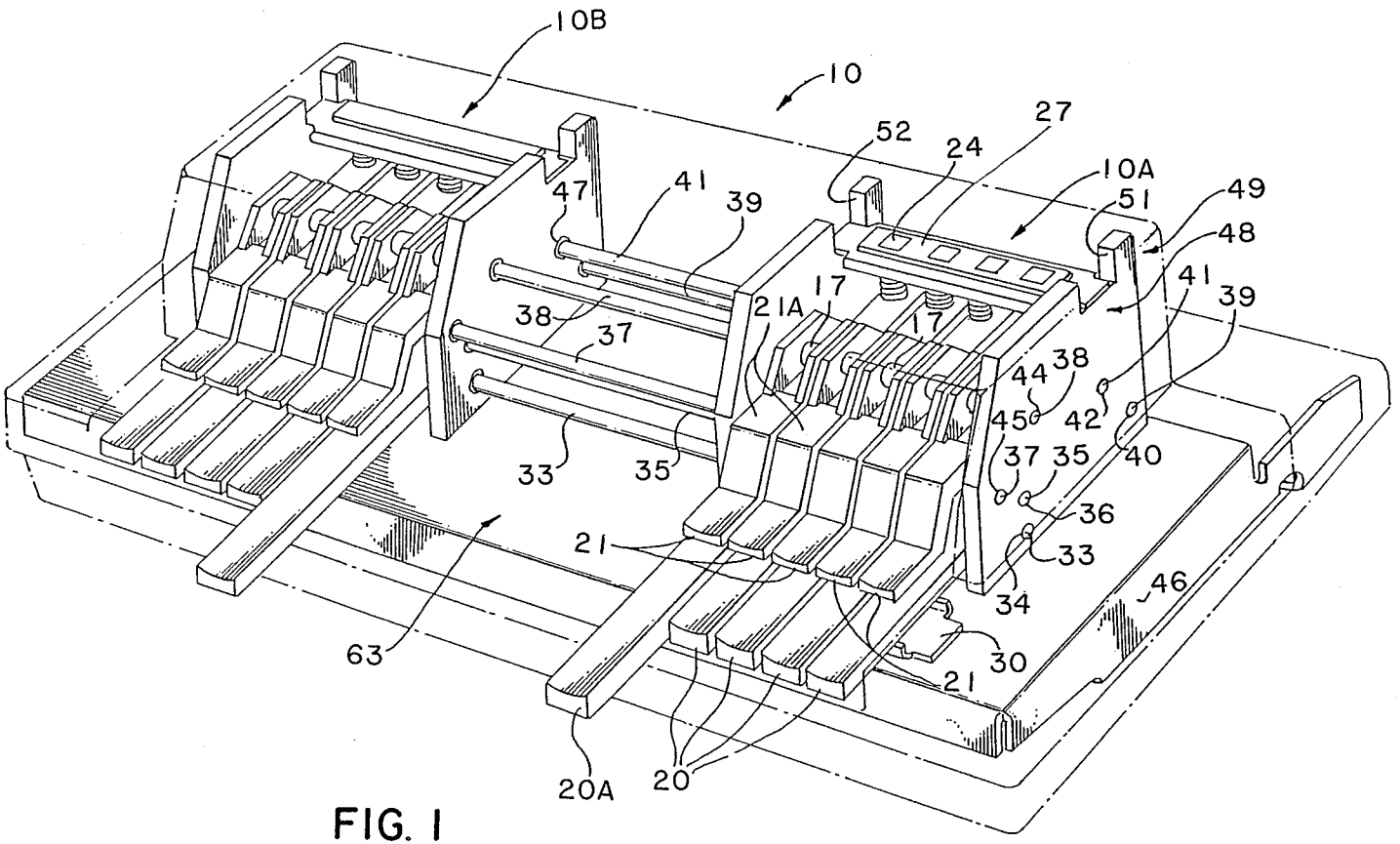
FIG. 1 shows a front perspective view of the mail sorting computer keyboard of the present invention.
Figure 2:
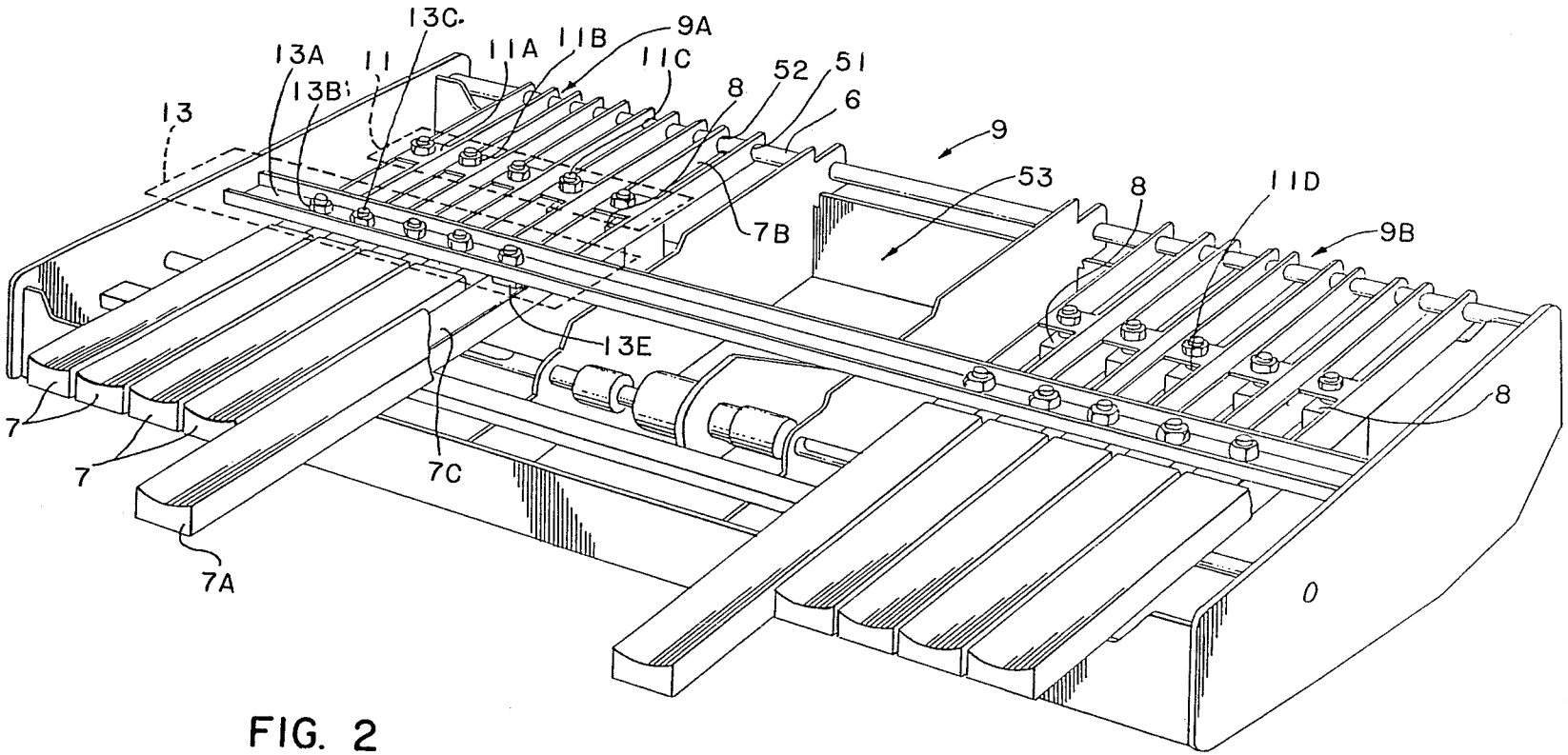
FIG. 2 PRIOR ART
FIG. 2 shows a front perspective view of a bottom portion of a typical prior art mail sorting keyboard.

In FIG. 1 there is shown a front perspective view of the mail sorting computer keyboard of the present invention being generally denoted by reference numeral 10. The keyboard 10 is disposed within a housing 49 which is partially shown in phantom lines in FIG. 1. Keyboard 10 includes a first portion 10A and a second keyboard portion 10B which are disposed in substantial transverse alignment with one another and are separated by a gap 63. Second keyboard portion 10B mirrors but is otherwise identical to first keyboard portion 10A, and therefore a description of one will convey a thorough understanding of the other. Keyboard portion 10A includes five lower keys 20 which are disposed in a first generally horizontal plane and are adapted for easy manipulation by the five fingers of the right hand of a user. It will be appreciated that key 20A of the five keys 20 is elongated such that it extends a predetermined distance beyond the keys adjacent thereto, so that key 20A may be easily depressed by the thumb of a user. Keyboard portion 10A includes vertical side plates 48 and 50 which, as shown in FIG. 1, extend vertically from a base plate 46 adjacent the outer most keys of the keys 20. Vertical plate 48 has disposed therein a plurality of spaced apart apertures 34, 36, 40, 42, 44 and 45. Vertical side plate 50 mirrors but it is otherwise identical to vertical plate 48 and therefore has disposed therein an identical plurality of apertures in transverse alignment with apertures 34, 36, 40, 42, 44 and 45. Disposed through these apertures transversely across the keyboard 10, are a plurality of rods 33, 35, 37, 38, 39 and 41. Each of these rods has a circular cross section and is locked into position on the keyboard 10 by virtue of U-shaped fasteners 47 disposed adjacent to the outer surface (not shown) of vertical side plate 50 and the inner surface of the vertical side plate 61 of the keyboard portion 10B. Keys 20 have disposed thereunder a transversely extending plate 30 (shown in FIG. 6). Under each key of the five keys of keys 20 there is disposed a switch 32 (shown in FIG. 6) having a pressure actuated portion (shown in FIG. 6) that will later be discussed in more detail.

Disposed generally above the lower keys 20 are upper keys 21 which are disposed in a second horizontal plane in substantial transverse alignment with one another. Keys 21 each have an upper portion 21A and a flange portion 21B which will later be discussed. Vertical side plates 48 and 50 have aligned recess portions 52 and 51 in which is disposed a transverse plate 27. Along transverse plate 27 and disposed directly above each upper portion **21*a* of the keys 21 there is disposed a switch 24 having a pressure actuated portion 53 (shown in FIGS. 5 and 6) which is actuated upon depression of a corresponding key of the keys 21**.

Figure 3:
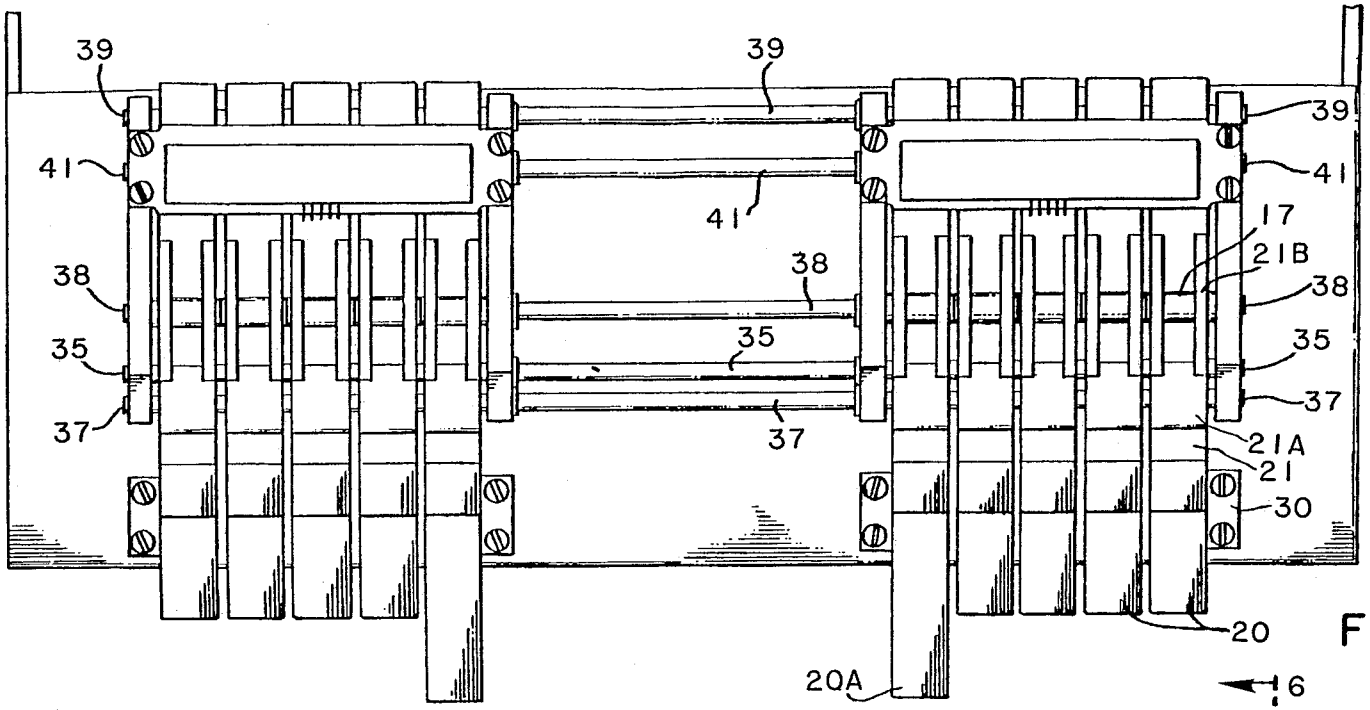
FIG. 3 shows a top plan view of the invented mail sorting computer keyboard.
Figure 4:
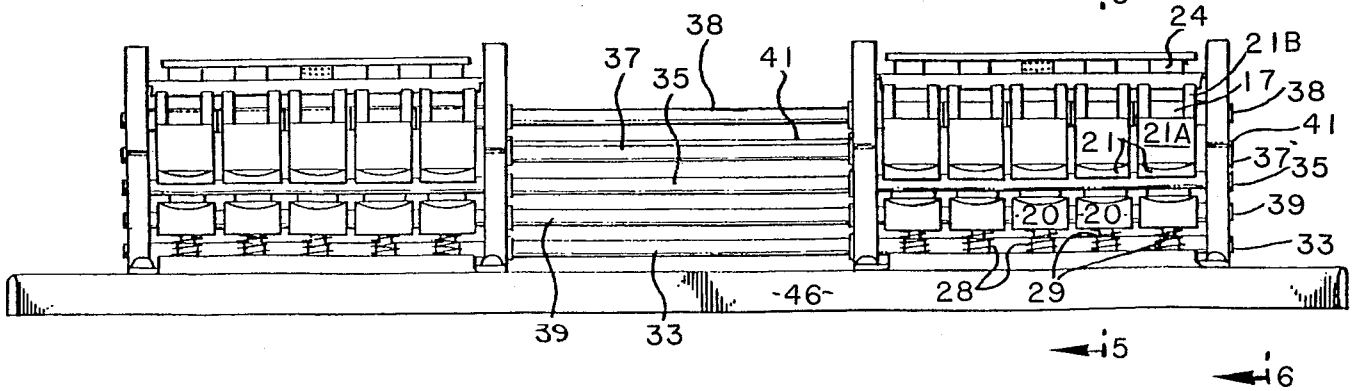
FIG. 4 shows a rear elevational view of the invented mail sorting computer keyboard.
Figure 6:
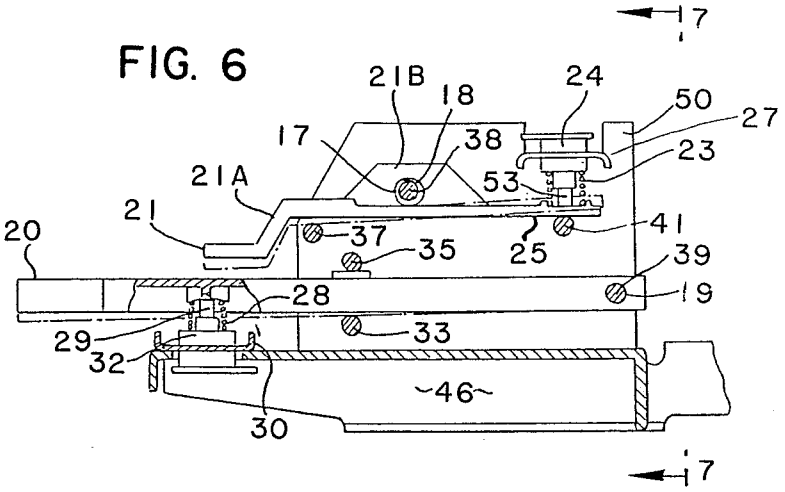
FIG. 6 shows right side partially cut-away elevational view of the invented mail sorting computer keyboard.
Figure 5:
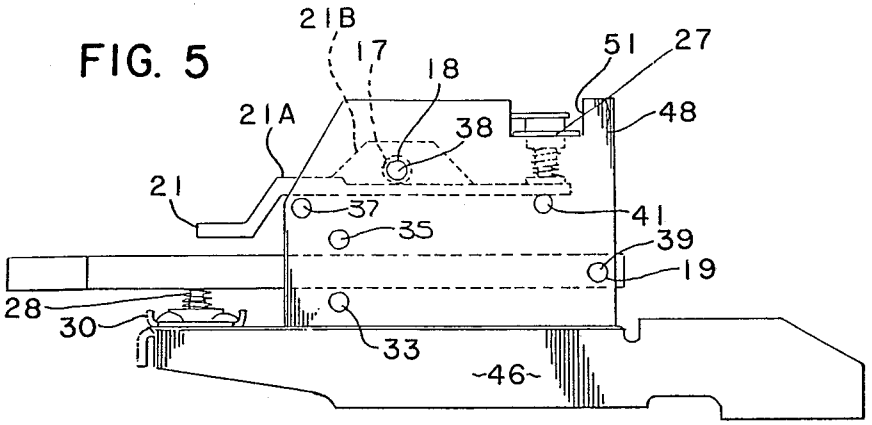
FIG. 5 shows a right side elevational view of the invented mail sorting computer keyboard.
Figure 7:
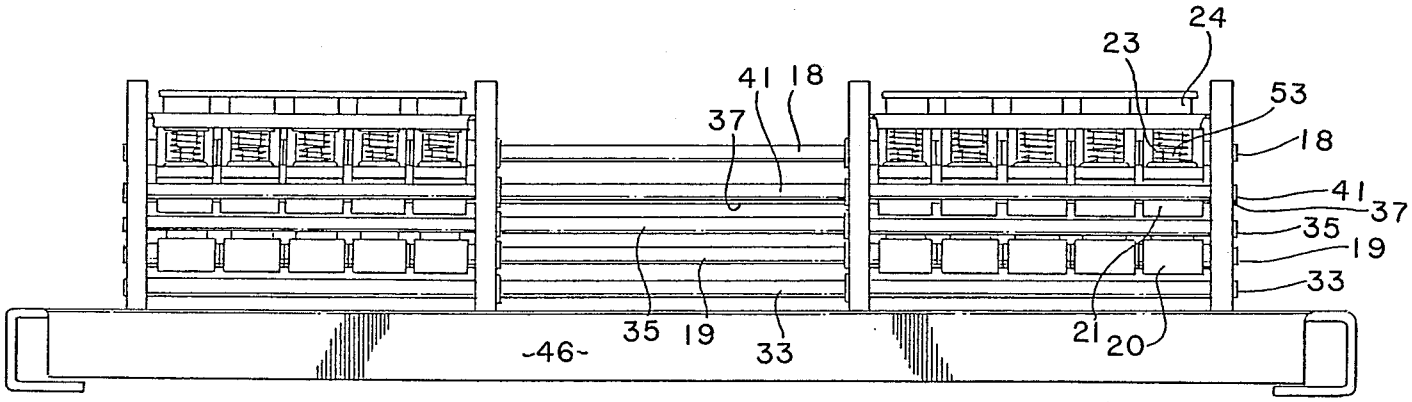
FIG. 7 shows a rear elevational view of the invented mail sorting computer keyboard.

Reference will now also be made to FIGS. 3–7 which, collectively, illustrate various views of the invented keyboard 10 such that the elements of the keyboard 10 and the operation thereof will be more fully conveyed. In FIG. 3 there is shown a top plan view of the invented keyboard 10 while FIG. 4 shows a front elevational view thereof. In FIG. 5 there is shown a right side elevational view of the invented keyboard 10 showing vertical side plate 48 and keys 20 and 21 in partial phantom lines. In FIG. 6 there is shown a right side elevational view of the invented keyboard 10 with vertical side plate 48 removed and denoting movement of the keys 21 and 20 by showing a depressed position of the keys in phantom lines. As is apparent from FIG. 6, when any key of the lower keys 20 are depressed, the bottom edge of the lower keys 20 comes into abutting contact with longitudinal rod 3 such that longitudinal rod 33 determines the extent of downward movement of each key of the lower keys 20. As is also apparent from FIG. 6, when any key of the keys 20 is depressed as previously described, the corresponding pressure actuated portion 29 of switch 32 also becomes depressed thereby conveying an electrical signal to a mail sorting computer keyboard system interfaced with the keyboard 10. After a user releases the keys 20 from the depressed position, a spring 28 upwardly pushes a corresponding key of the keys 20 such that a felt type portion 30 which is disposed on each key of the keys 20 in alignment with the rod 35, comes into abutting contact with longitudinal rod 35, thereby determining the extent of upward movement of each of the keys 20. Each key of the keys 20 has an aperture which is transversely disposed in the rearward portions of the keys and which are collectively referred to in FIGS. 5 and 6 by the reference numeral 19 (i.e. FIGS. 5 and 6 show the outermost key of the keys 20 and an outermost aperture of the apertures 19). As indicated in FIGS. 5 and 6, disposed through apertures 19 is longitudinal rod 39. Rod 39 and apertures 19 collectively form a pivot means for each of the keys 20. Since rod 35 limits the amount of upward movement of each key of the keys 20 while rod 33 limits the amount of downward movement of each of the keys 20, alignment of each of the keys 20 is entirely dependent upon the location of rods 33 and 35. Moreover, since rods 33 and 35 are fixedly mounted to vertical side plates 48 and 50, the keys 20 do not go out of alignment and do not require further alignment and periodic realignment. Accordingly, in use of the invented keyboard 10, each switch of switches 32 are continuously and properly actuated upon depression of a corresponding key of the keys 20.

As stated and shown in FIGS. 1–7, each key of the upper keys 21 have a upper portion **21*a* and a flange portion 21*b* disposed centrally on the key. Each flange portion 21*b* has a pair of apertures which are collectively referred to in FIGS. 5 and 6 by reference numeral 18 (i.e. FIGS. 5 and 6 show the outermost keys of the keys 21 and an aperture of apertures 18). As shown in FIGS. 1 and 3, each apertures 18 of each flange portion 21*b* has disposed therein a collar 17 which, in the preferred embodiment is comprised of metallic material. The apertures 18 of flange portions 21*b* and collars 17 of each key of the keys 21 are disposed in transverse alignment with one another and have a longitudinal rod 38 disposed therethrough such that, collectively, longitudinal rod 38, apertures 18 and collars 17 provide a pivot means for each key of the keys 21**.

As shown in FIGS. 5 and 6, a longitudinal rod 41 is disposed transversely under a rear portion 25 of each key of the keys 21. Disposed above rod 41 and rear portion 25 is the switch 24. As discussed with reference to FIG. 1, switch 24 has a pressure actuated portion 53 such that when a key 21 is depressed, rear portion 25 will move upwardly thereby depressing pressure actuated portion 53, as indicated in FIG. 6, and closing switch 24 to convey a desired electrical signal. Each key of the keys 21 has a spring 23 disposed between rear portion 25 and switch 24. Spring 23 continuously exerts a downward force upon rear portion 25 such that, when a key 21 is released after being depressed, spring 23 pushes a key of the keys 21 at the corresponding rear portion 25 to its maximum downward position against rod 41. It will be thus appreciated, that rod 41 defines the extent of the downward movement of each rear portion of the keys 21.

Conversely as shown in FIG. 6, rod 37 defines the extent of the upward movement of each rear portion 25 of each key of the keys 21, when a key is depressed by a user. Similar to rods 35 and 33 and the keys 20, rods 41 and 37 collectively limit the extent of, respectively, downward and upward movement of the rear portion 25 of each key. Rod 37 also limits the extent of downward movement of the upper portion **21*a* of each key of the keys 21 such that in operation, the keys continuously pivot within a predetermined arc which is defined by the location of rods 41 and 37, thereby effectuating a permanent rotational alignment of each key of the keys 21. As such, each one of the pressure actuated portions 53 are continuously and properly actuated upon depression of a corresponding key thereby continuously iniciating desired electrical signals which represent depression of a corresponding key of the keys 21, over the course of the operation of the keys 21 and without the requirement of periodic realignment of the keyboard 10**.

Figure 8:
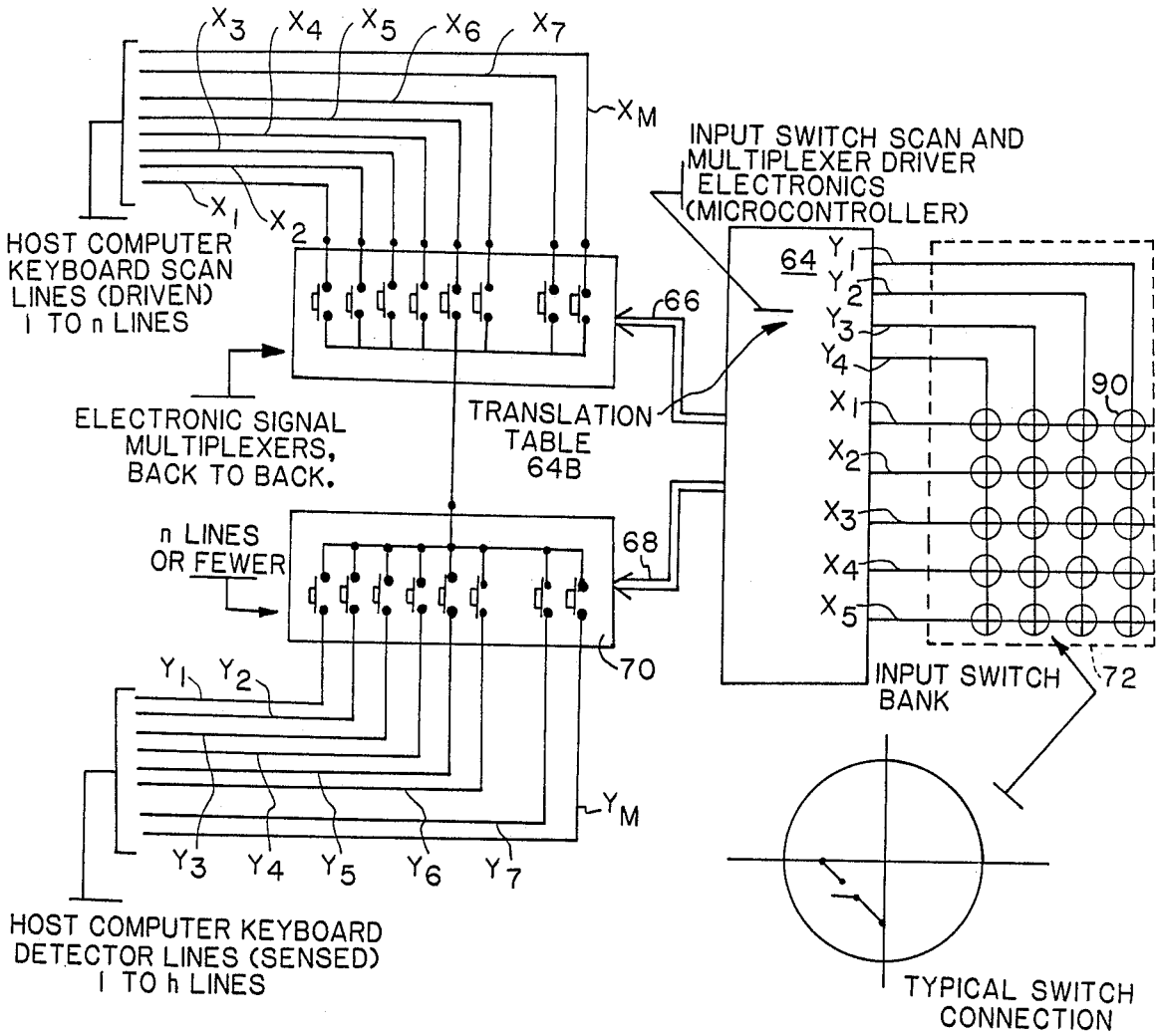
FIG. 8 shows a block diagram of a circuit employed with invented mail sorting computer keyboard.

In FIG. 8 there is shown a block diagram of a circuit for use with the invented mail sorting computer keyboard 10 which permits the keyboard 10 to be interfaced with a variety of different computer systems. The plurality of electrical switches for keyboard portions 10A and 10B of the keyboard 10 (which have previously been discussed with reference to FIGS. 1 and 37) are represented in FIG. 8 by the circles within dotted box 72. Each switch of the electrical switches within the box 72 have an X and a Y coordinate (i.e. $X_{1-5}$ and $Y_{1-4}$) such that the switch 90 at the top right hand corner of box 72 has the coordinates of $X_1$, $Y_1$. Depression of any one of the keys of the keyboard 10 will close the corresponding a switch at a particular X, Y coordinate. The closed switch will assert a signal on the corresponding X line to the microcontroller 64 thereby communicating to the same which X line has a signal thereon.

In order to sense which key has been depressed, a microcontroller 64 asserts a signal on lines $Y_1$, $Y_2$, $Y_3$, $Y_4$. The Y line which corresponds with a depressed key will be detected by microcontroller 64. When the X line signal is asserted and the Y line signal is detected the microcontroller 64 will then have the X, Y coordinates of the depressed key. In such a manner, detection of the depression of a particular key is sensed and determined by the microcontroller 64.

After detection of the X, Y coordinates of the depressed key, a translation table **64*b* (comprised of RAM, ROM or other well known digital memory and combinative devices) then translates the X, Y coordinates of the depressed key into corresponding X, Y coordinates of the host computer with which the invented mail sorting computer keyboard is interfaced. After translation of the X, Y coordinate of the depressed key, the microcontroller 64 outputs the translated X coordinate to a multiplexer 74 via bus 66 and also transmits the translated Y coordinate via bus 68 to a multiplexer 70. As shown in FIG. 8, multiplexers 74 and 70 are coupled back to back via jumper 96 and are comprised of a plurality of electrically actuated relays which are used to electrically represent the keyboard of the host computer. Multiplexer 74 is employed to convey information of the translated X coordinates of the keyboard of the host computer while multiplexer 70 is used to convey information of the translated Y coordinates of the host computer keyboard. As with the microcontroller 64, the host computer asserts a signal at multiplexer 70 on Y lines $Y_1$–$Y_n$ and only the relay which has been closed therein (by the Y coordinate information transmitted by the microcontroller 64) will conduct that signal. The host computer will then scan the lines $Y_1-Y_n$ to determine which corresponding Y relay has been closed. Similarly, the host computer will scan the lines $X_1-X_n$ to determine which relay of multiplex 74** has been closed by the X coordinate transmitted to multiplexer 74 by microcontroller 64. At this point the host computer will have the X, Y coordinates that correspond to the coordinates the mail sorting computer keyboard. It will be appreciated therefore that the invented mail sorting computer keyboard may be interfaced and employed with a wide variety of different types of computers regardless of whether or not the particular computer is capable of being directly driven by the mail sorting computer keyboard. Moreover, the translator 64B of the microcontroller 64 can be designed to translate the X, Y coordinates of the keys of the mail sorting computer keyboard such that buses 6 and 68 output translated information of nearly any type desired. It will be further appreciated that the circuit of FIG. 8 accomplishes the above by replacing the keyboard of the host computer with multiplexors 70 and 74. The circuit of FIG. 8 may also be employed with keyboards other than the invented mail sorting computer keyboard such that, by employing a circuit of FIG. 8, nearly any type of digital keyboard may be used to communicate with nearly any type of computer.

It will be appreciated that the above-described invention may spirit or essential characteristics thereof. The present embodiments are, therefore, to be considered in all aspects as illustrative and not restrictive, the scope of the invention being indicated by the appended claims rather than the foregoing description, and all changes which come within the meaning and range of equivalency are, therefore, intended to be embraced therein.

What is claimed is:

1. A keyboard comprising:

a plurality of keys, said plurality of keys being disposed in substantial transverse alignment with one another, each key of said plurality of keys having an aperture extending transversely therethrough; said plurality of keys further comprising a first group of keys having a front portion, and a rearward portion disposed in a first plane and a second group of keys disposed in a second plane, said second group of keys having a front portion and being disposed under said first group of keys and in substantial cross-sectional alignment therewith;

a means for pivotally supporting said keys, said means for pivotally supporting being disposed through each of said apertures thereby providing a pivot means for each of said keys; said means for pivotally supporting comprising a first rod disposed transversely through said first group of keys and a second rod disposed transversely through said second group of keys such that said first rod, said second rod and said apertures collectively provide first and second pivot means for, respectively, said first group of keys and said second group of keys;

a first means for limiting the extent of pivotal movement, in a first direction, of said keys, said first means for limiting being transversely and fixedly disposed adjacent said keys;

said first means for limiting comprising:

a third rod transversely extending across said keyboard and under said front portion of said first group of keys thereby limiting the extent of underline pivotal movement of said front portion of each key, of said first group of keys;

a fourth rod disposed underneath and transversely extending across a front portion of said second group of keys, thereby limiting the extent of downward movement, of said front portion of said second group of keys;

said second means for limiting comprising:

a fifth rod disposed below and transversely extending across said rearward portion of said first group of keys thereby limiting the extent of upward pivotal movement of said front portion of said first group of keys;

a sixth rod disposed above and transversely extending across said front portion of said second group of keys such that said sixth rod limits the extent of upward pivotal movement of said front portion of each of said second group of keys;

wherein said first means for limiting and said second means for limiting collectively and fixedly define the range of pivotal movement of each of said plurality of keys thereby substantially eliminating the need for readjustment and realignment of said keyboard.

2. A keyboard comprising:

a plurality of keys, said plurality of keys each having an aperture extending transversely therethrough disposed in a first plane and a second group of keys disposed in a second plane, said second group of keys being disposed under said first group of keys and in substantial cross-sectional alignment therewith;

a means for pivotally supporting said keys, disposed through each of said apertures thereby providing a pivot means for each key of said plurality of keys; said means for pivotally supporting further comprising a first rod disposed transversely through said first group of keys and a second rod disposed transversely through said second group of keys such that said first rod, said second rod and said apertures collectively provide first and second pivot means for, respectively, said first group of keys and said second group of keys, a means for biasing each of said keys;

a first means for limiting pivotal movement of said keys fixedly transversely disposed adjacent said plurality of keys and parallel to said means for pivotally supporting said keys wherein said first means for limiting determines the extent of pivotal movement of said keys in a first direction; said first means for limiting comprising:

a third rod transversely extending across said keyboard and under a front portion of said first group of keys thereby limiting the extent of downward pivotal movement in of front portion of each key of said first group of keys;

a fourth rod transversely extending below said second group of keys thereby limiting the extent of downward pivotal movement of a front portion of said second group of keys;

pressure actuated switches being disposed in opposing relationship with said plurality of keys such that when a one of said plurality of keys is struck a corresponding one of said plurality of switches is actuated;

a second means for limiting pivotal movement of said keys, transversely disposed adjacent said plurality of keys wherein said second means for limiting determines the extent of pivotal movement of said keys in a second direction;

said second means for limiting comprising:

a fifth rod disposed above and transversely extending across a front portion of said second group of keys, thereby limiting the extent of upward movement of a front portion of each of said keys of said second group of keys;

a sixth rod disposed underneath and transversely extending across a rearward portion of said first group of keys such that said fifth rod limits the extent of upward movement of said front portion of each of said first group of keys.

* * * * *